US005269362A

United States Patent [19]

Yamashita

[11] Patent Number: 5,269,362

[45] Date of Patent: Dec. 14, 1993

[54] AUTOMATIC MOLTEN METAL DISTRIBUTION SYSTEM

[75] Inventor: Satoshi Yamashita, Saitama, Japan

[73] Assignee: Hitachi Metals Ltd., Tokyo, Japan

[21] Appl. No.: 836,513

[22] Filed: Feb. 18, 1992

[30] Foreign Application Priority Data

Apr. 18, 1991 [JP] Japan ..... 3-115390

[51] Int. Cl.[5] ..... B22D 35/00; B22D 46/00

[52] U.S. Cl. ..... 164/155; 164/4.1; 164/457; 164/133

[58] Field of Search ..... 164/155, 150, 154, 4.1, 164/457, 133

[56] References Cited

U.S. PATENT DOCUMENTS

| | | | |
|---|---|---|---|
| 3,818,971 | 6/1974 | Schutz | 164/457 |
| 3,856,182 | 12/1974 | Berthet et al. | 164/155 |
| 4,153,100 | 5/1979 | Baleuski et al. | 164/155 |
| 4,967,827 | 11/1990 | Campbell | 164/133 |
| 4,977,946 | 12/1990 | Borrousch et al. | 164/133 |

FOREIGN PATENT DOCUMENTS

| | | | |
|---|---|---|---|
| 0191560 | 10/1984 | Japan | 164/457 |

*Primary Examiner*—Richard K. Seidel
*Assistant Examiner*—Erik R. Puknys
*Attorney, Agent, or Firm*—Sughrue, Mion, Zinn, Macpeak & Seas

[57] ABSTRACT

Herein disclosed is an automatic molten metal distribution system having a function to automatically decide what one of the reserving furnaces 31 of a plurality of casting machines 30 the molten metal 36 is to be distributed. The automatic molten metal distribution system comprises: a molten metal distributor 20 for distributing the molten metal 36 to the individual reserving furnaces 31 of the plurality of casting machines 30; cast amount metering apparatus 39 for metering the individual cast amounts cast by the casting machines 30; and distributor control apparatus 22 for controlling the distributor 20 so as to distribute the molten metal 36, when the cast amount cast by any casting machine metered by the cast amount metering apparatus 39 reaches a preset cast amount set for each of the casting machines 30, to the reserving furnace 31 of said any casting machine 30.

12 Claims, 5 Drawing Sheets

AUTOMATIC MOLTEN METAL DISTRIBUTION SYSTEM

BACKGROUND OF THE INVENTION

1. Field of the Invention

The present invention relates to a molten metal distribution system for distributing the molten metal in a furnace to reserving furnaces of a plurality of low pressure casting machines and, more particularly, to an automatic molten metal distribution system having a function to automatically decide what one of the reserving furnaces of the low pressure casting machines the molten metal is to be distributed.

2. Description of the Prior Art

An automatic molten metal distribution system for distributing the molten metal automatically from a furnace to a plurality of casting machines is disclosed in Japanese Patent Publication No. 15350/1989. In this system a human operator depresses each push button, when the corresponding casting machine is prepared for receiving the molten metal, to issue molten metal pour instructing signal, and each signal is sequentially stored so that the molten metal is poured into the casting machines in accordance with the stored sequence.

This automatic molten metal distribution system of the prior art can be applied to gravity casting machines each having no reserving furnace so that the molten metal to be distributed is poured directly into each die and is cast one by one, but not to low pressure casting machines, for example, in which the molten metal is poured into each reserving furnace of the machine so that it is usually cast plural times by one or more casting dies of each machine. In the low pressure casting machine the molten metal can always be poured, if intended so, into the reserving furnace unless it is so much in the reserving furnace as will overflow. Thus, one can not fix the end of preparation for receiving the molten metal, and the afore-mentioned prior art cannot be applied to the low pressure casting machines. In case, on the other hand, each pour instructing signal is issued when the molten metal in the corresponding reserving furnace is too short to cast, the second and subsequent machines will have excessive standby times if such pour instructing signals are substantially simultaneously issued from the plurality of machines.

SUMMARY OF THE INVENTION

It is, therefore, an object of the present invention to provide an automatic molten metal distribution system which can be applied to a plurality of casting machines having reserving furnaces and which has a function to automatically decide what one of reserving furnaces of the casting machines the molten metal is to be distributed to.

The above-specified object is achieved by providing an automatic molten metal distribution system which comprises: a molten metal distributor for distributing molten metal to individual reserving furnaces of a plurality of casting machines; cast amount metering means for metering individual cast amounts cast by said casting machines; and distributor control means for controlling said distributor so as to distribute said molten metal, when the cast amount cast by any casting machine metered by said cast amount metering means reaches a preset cast amount set for each of said casting machines, to the reserving furnace of said any casting machine.

Specifically, the distributor of the invention starts to distribute the molten metal when the cast amount of each casting machine reaches its preset amount, so that this automatic molten metal distribution system can be applied to a plurality of low pressure casting machines. By setting each preset cast amount of the casting machine in consideration of the distribution time period required for one machine, the standby of the second and subsequent machines will not occur or standby time will be suppressed, if any, to the minimum, even if the cast amounts of two or more casting machines reach their preset amounts substantially simultaneously, that is, the distributor is asked to distribute the molten metal substantially simultaneously from two or more machines. The preset cast amount can be set sufficiently small compared to the capacity of each reserving furnace, if the prevention of the standby of the second and subsequent machines is preferred. If, however, the preset amount is excessively small, the running frequency of the distributor increases to decrease the efficiency of the whole system. It is, therefore, advisable to determine the preset amount by balancing the above points.

Moreover, the distributor control means can be constructed: to calculate individual extents of approach of the individual cast amounts to the individual preset cast amounts to determine the maximum and next maximum in the extent of approach; and to control the distributor so as to distribute the molten metal, when the cast amount cast by any casting machine reaches its preset cast amount, or when the maximum reaches a first preset approach value and the next maximum reaches a second preset approach value less close than the first preset approach value, to the reserving furnace of said any casting machine, or the reserving furnace of the casting machine having said maximum, respectively. With this construction, when the cast amounts of or more casting machines approach their preset cast amounts, the distributor will start to distribute the molten metal in advance anticipating that the cast amounts would otherwise reach their preset amounts substantially simultaneously. This means that it is possible to set the preset amount comparably large with the capacity of each reserving furnace without inviting the standby of the second and subsequent machines. Thus the running frequency of the distributor can be decreased to increase the efficiency of the whole system.

BRIEF DESCRIPTION OF THE DRAWINGS

Other objects and advantages of the present invention will become apparent from the following description to be made with reference to the accompanying drawings, in which.

DETAILED DESCRIPTION OF THE PREFERRED EMBODIMENT

Figure 1:
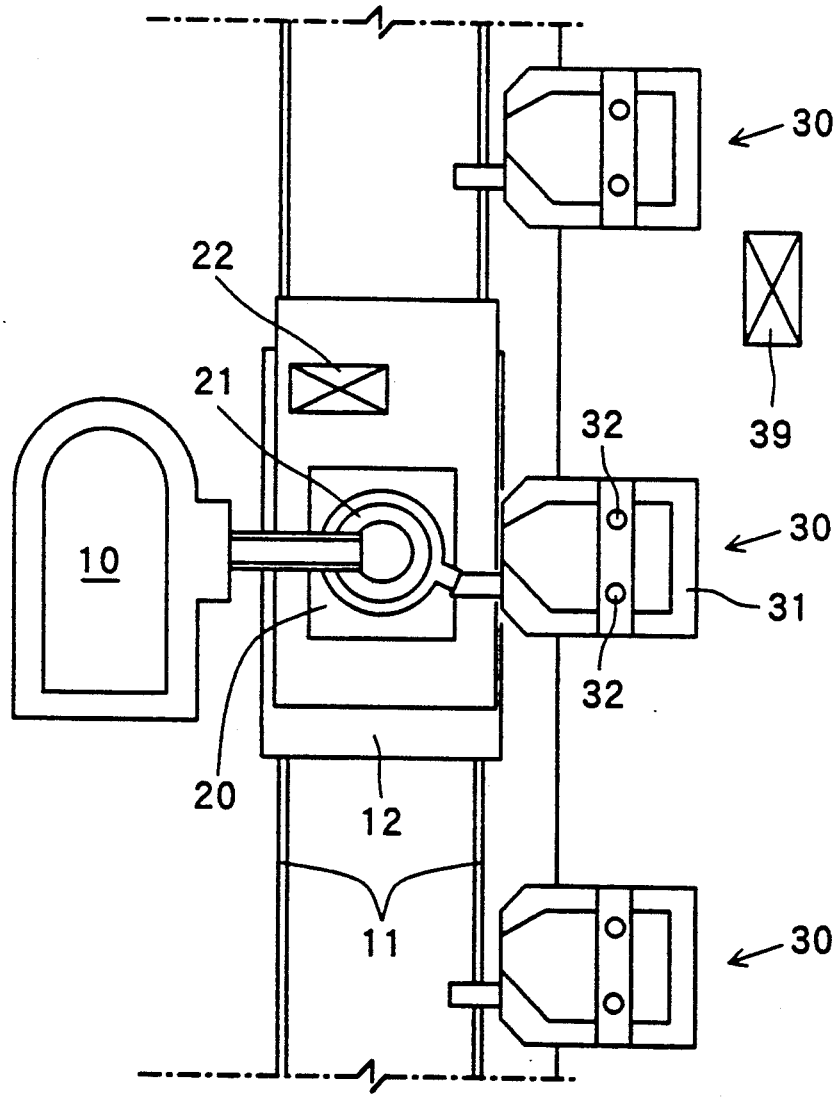
FIG. 1 is a schematic top plan view showing a molten metal distributor according to one embodiment of the present invention together with a furnace and casting machines.

An embodiment of the present invention will be described with reference to the accompanying drawings. In referring FIG. 1 a furnace 10 is faced by two rails 11 and 11, on which a truck 12 can move while carrying a molten metal distributor 20 and a distributor control apparatus 22. The distributor 20 is equipped with a tilting furnace 21 which can be tilted by about 90 degrees on a horizontal axis by the action of a cylinder (not shown). The tilting furnace 21 is equipped with a weight meter (not shown) for measuring the weight of the molten metal in it. At the opposite side of the furnace 10 across the rails 11 and 11, there are disposed totally ten (only three being shown) low pressure casting machines 30. In FIG. 1, however, each casting machine 30 has only its reserving furnace 31 and two stokes 32 and 32 shown but its body removed. Adjacent to the casting machines 30, there is disposed a cast amount metering apparatus 39. The distributor control apparatus 22 compares the cast amounts cast by the individual casting machines 30 and their predetermined values to start the distributor 20 when the cast amounts reach the predetermined values. The cast amount metering apparatus 39 meters individual cast amounts cast by the machines 30.

The distributor 20 operates as follows. First of all, the distributor 20 is moved to face the furnace 10 to receive the molten metal from the furnace 10, and the weight of the molten metal in the tilting furnace 21 is measured by the weight meter. However, the molten metal need not be poured from the furnace 10 directly into the distributor 20, but its component may be adjusted in an intermediate furnace and then poured into the distributor 20. Next, the distributor 20 is moved to face one of the low pressure casting machines 30, and the molten metal in the tilting furnace 21 is distributed into the reserving furnace 31 of the machine 30 under consideration. The weight of the molten metal left in the tilting furnace 21 is then measured by the weight meter to determine the weight of the molten metal distributed to the reserving furnace 31, from the difference from the preceding weight of molten metal. This weight of distributed molten metal is utilized for controlling the furnace 10.

Figure 2:
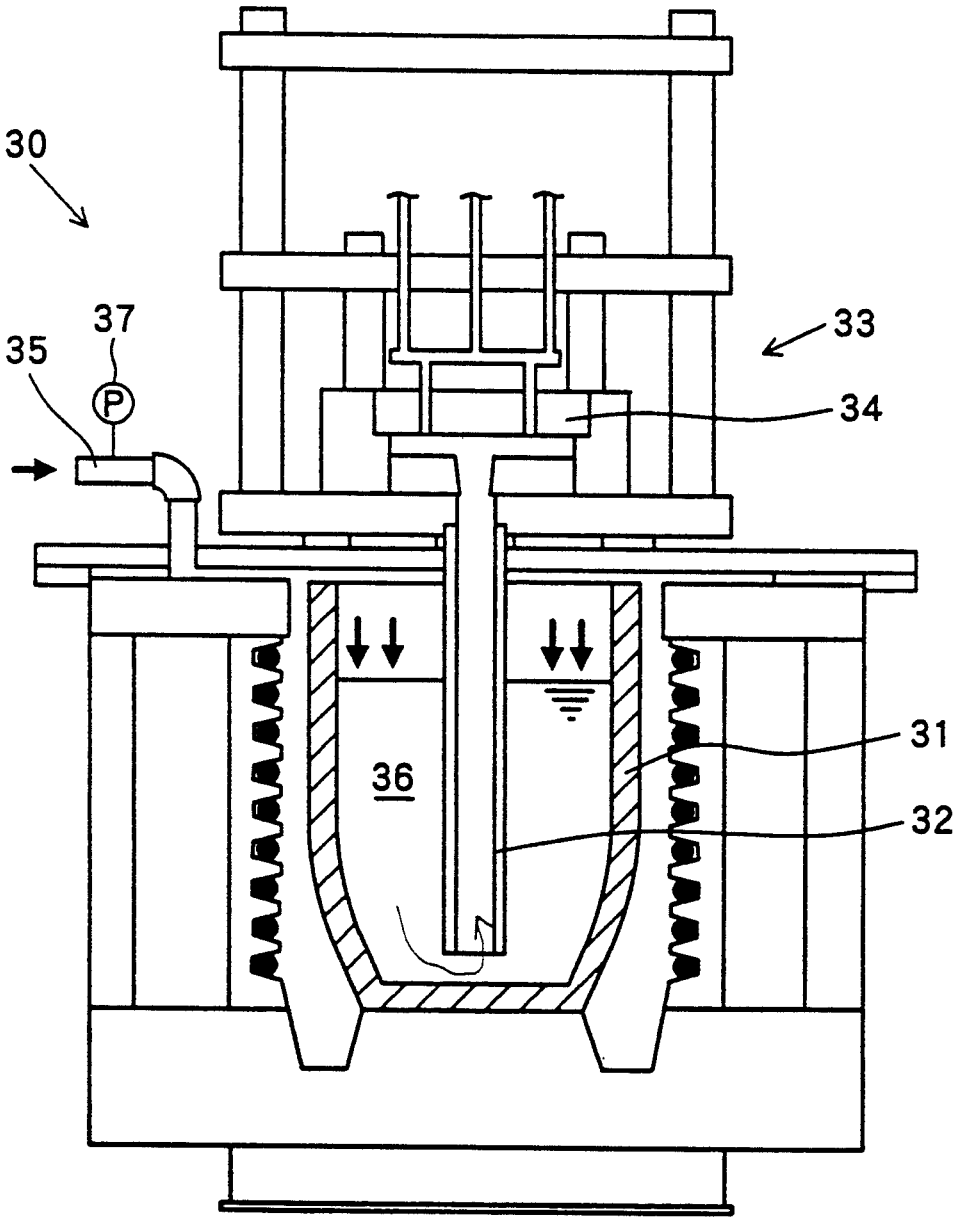
FIG. 2 is a schematic longitudinal section showing the casting machine to explain a cast amount metering apparatus of the embodiment.
Figure 3:
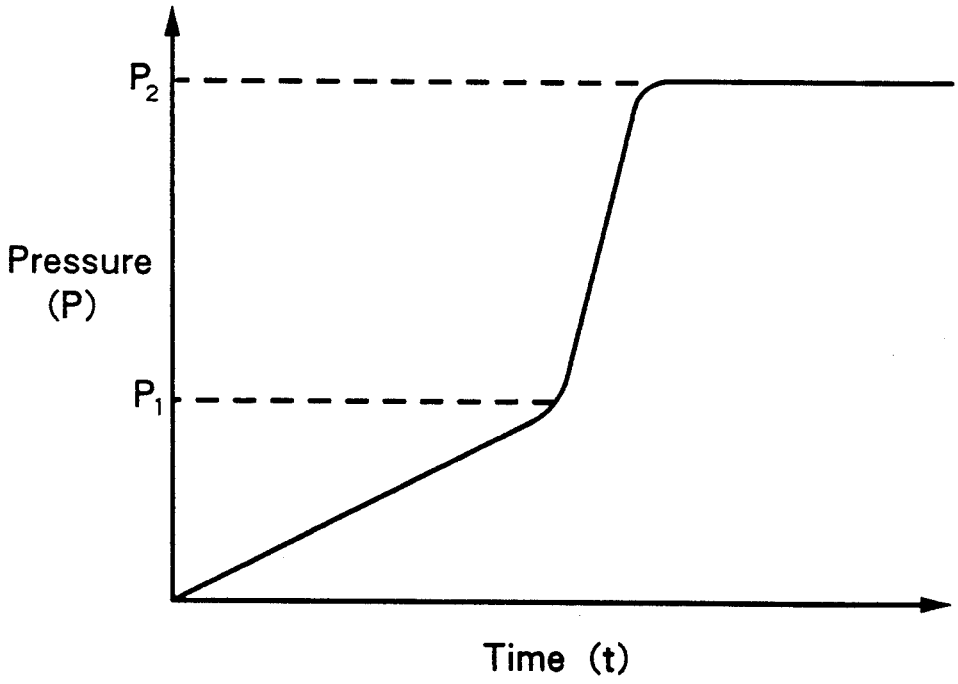
FIG. 3 is a time chart showing the casting pressure of the casting machine to explain the cast amount metering apparatus.

Here will be described the metering method of the cast amount metering apparatus 39 for metering each amount of the molten metal cast by each low pressure casting machine 30. In referring FIG. 2 each machine 30 is equipped with the reserving furnace 31 and a machine body 33, in which two (only one being shown) dies 34 are replaceably fixed. If dry air is compressed into the reserving furnace 31 from its pressure entrance 35 attached to the reserving furnace 31, its pressure forces the molten metal 36 in the reserving furnace 31 into the dies 34 through their stokes 32. After the molten metal solidifies in the dies 34 to form casting articles, the articles are discharged out of the machine body 33 by opening the dies 34. To the dry air pressure entrance 35, there is attached a pressure sensor 37 which, in usual low pressure casting, has a pressure P changing with time t as shown in FIG. 3. Specifically, the pressure P is at first forced to rise gradually to a level $P_1$ and then to jump abruptly to a level $P_2$, where the pressure P is held for a while, and the casting is finished. The pressure level $P_1$ may be exemplified by 0.35 $Kgf/cm^2$-g, and the pressure level $P_2$ may be exemplified by 1.0 $Kgf/cm^2$-g. The pressure rise to the level $P_1$ corresponds to the moving and filling up of the molten metal 36 into the cavity of the dies 34. That is, if the pressure P rises to the level $P_1$, then the casting articles never fail to exist in their forms, not to mention their quality, even if the pressure P should fail to jump up to the level $P_2$. Therefore, the number of casting articles can be increased by two, as each casting machine 30 has two dies 34 and stokes 32, at the time when the pressure P rises to the level $P_1$, and the cast amount cast by the machine 30 can be calculated by adding both weights of the articles or, if both articles are the same, by multiplying the number of casting articles by the weight of one article. In the present cast amount metering apparatus 39, however, the number of casting operations, instead of the number of casting articles, is increased by one at the time when the pressure P rises to the level $P_1$, and the cast amount is calculated by multiplying the number of casting operations by the total weights of the articles in one operation.

Next, control method taken in the distributor control apparatus 22, that is, the method of deciding what reserving furnace 31 of the low pressure casting machine 30 the molten metal should be distributed to will be described with reference to FIG. 4. First of all, if an instruction to distribute the molten metal to the reserving furnace 31 of an n-th machine (n=1 to 10) is issued to the distributor 20, the molten metal is poured from the furnace 10 into the tilting furnace 21 of the distributor 20 (at a of FIG. 4). The weight of the molten metal in the tilting furnace is measured by the weight meter (at b of FIG. 4). After this, the distributor is moved to the position of the reserving furnace of the n-th machine (at c in FIG. 4). Next, the molten metal is poured untill the level meter attached to the n-th reserving furnace indicates the upper limit (at d in FIG. 4). Then, the initial position is restored (at e in FIG. 4), and the weight of the molten metal left in the tilting furnace is measured (at f in FIG. 4) so that the weight of the molten metal poured into the n-th reserving furnace is determined (at g in FIG. 4) from the difference from the initial weight of the molten metal in the tilting furnace.

Figure 4:
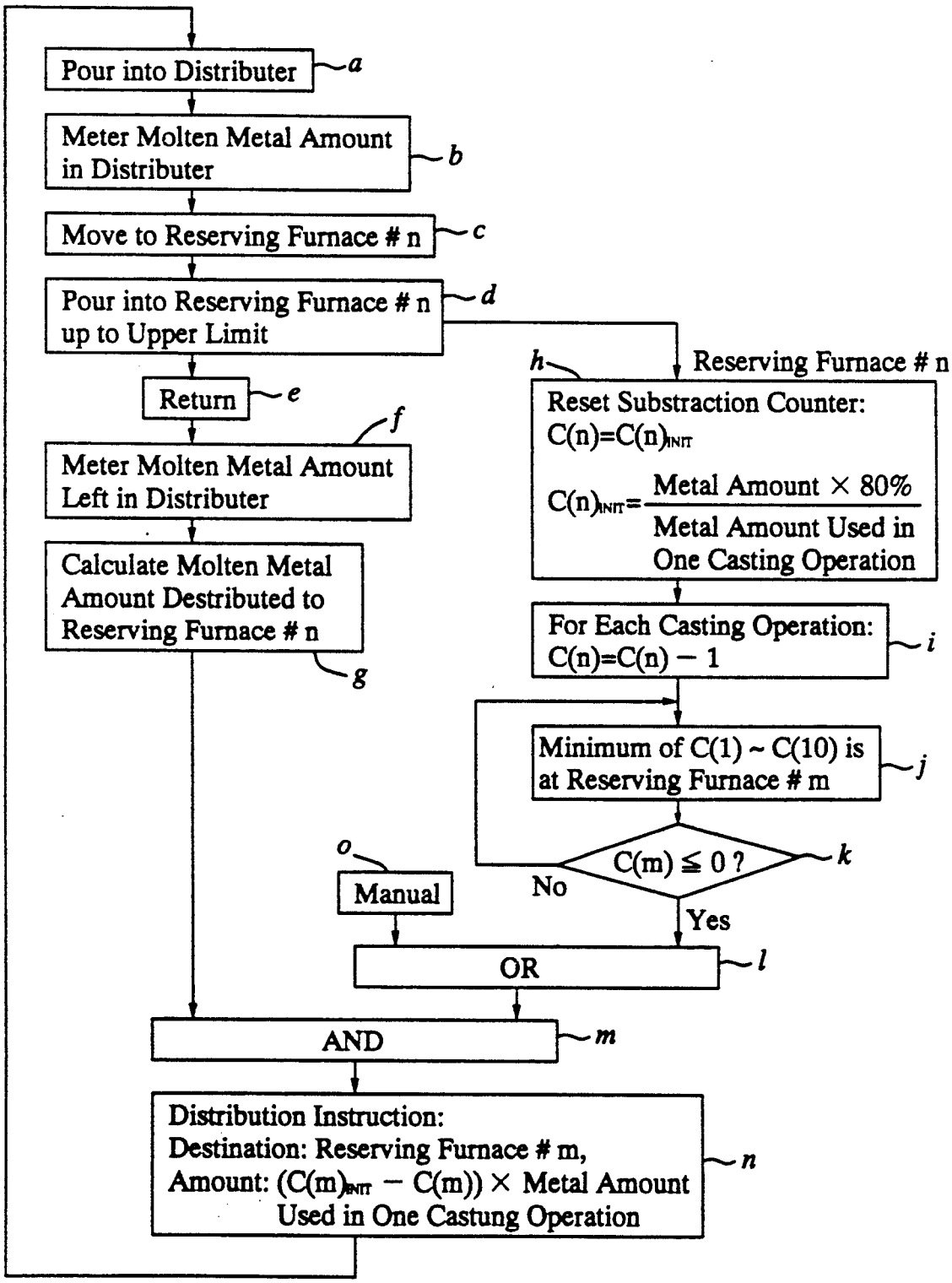
FIG. 4 is a flow chart showing control method of distributor control apparatus of the embodiment.

When, on the other hand, the level meter of the n-th reserving furnace reaches the upper limit, the value C(n) of a subtraction counter representing the number of casting operations of the n-th casting machine is reset to a initial value $C(n)_{INIT}$ (at h in FIG. 4). This initial value $C(n)_{INIT}$ for resetting the value C(n) of the subtraction counter is determined as follows. When each level meter of the reserving furnace indicates the upper limit, the weight of the molten metal in each reserving furnace is about 750 Kg and about 80% of the molten metal is to be cast by a single distribution in the present embodiment. And as both casting articles are the same and the weight of one article is 6 Kg in the present embodiment, a molten metal of 12 Kg is used by a single casting operation. Hence, the single distribution is enabled to achieve about fifty casing operations from the following calculation:

$$(750\ Kg\ /\ distribution) \times 80\%\ /\ (12\ Kg\ /\ operation) = 50\ operations\ /\ distribution.$$

With $C(n)_{INIT}=50$, therefore, the value C(n) of the subtraction counter of the n-th casting machine is reset to C(n)=50. Subsequently, the value C(n) of the subtraction counter is decreased by 1 each time the pressure sensor 37 attached to the dry air pressure entrance rises to the pressure level $P_1$ (at i in FIG. 4). Since the capacity of the reserving furnace may be different for each casting machine, or the number or kind of the dies may be different for each machine, the initial value $C(n)_{INIT}$ of the value C(n) of the subtraction counter may not be equal for all the casting machines.

The minimum of the value C(n) (n=1 to 10) of each subtraction counter thus operated is monitored whether its minimum reaches to 0 (at j and k in FIG. 4). When the minimum reaches to 0 or is below 0, an instruction to distribute the molten metal to the reserving furnace of an m th casting machine giving said minimum is issued to the distributor (at n in FIG. 4). The amount of the molten metal to be distributed to the m-th reserving furnace takes a value which is calculated by multiplying the difference between the initial value $C(m)_{INIT}$ for the m-th reserving furnace and the present value C(m) by the weight of the molten metal necessary for a single casting operation of the m-th casting machine. But actually, however, a small amount is added to the calculated amount of the molten metal to be poured at a in FIG. 4. This is because the pouring into the reserving furnace (at d in FIG. 4) will never fail to cause the level meter of the reserving furnace to reach the upper limit. As a result, a little molten metal never fails to remain in the tilting furnace (at f in FIG. 4).

Since the time period required for one cycle of movement of the tilting furnace is fifteen to twenty minutes and one casting operation requires about five minutes in the present embodiment, each subtraction counter of other casting machines is decreased by 3 or 4 while the tilting furnace is distributing the molten metal to one reserving furnace. When the values of the subtraction counters of a number of casting machines drop to 0 substantially simultaneously, e.g., the subtraction counter of the second casting machine is approaching the value 0 at the time when the subtraction counter of the first casting machine reaches 0, the molten metal is first to be distributed into the first reserving furnace, and the subtraction counter of the second casting machine indicates −3 (minus three) or −4 at the time when the pouring into the first reserving furnace is finished. Despite of this fact, however, each casting machine is enabled to operate the following excess casting operations by a single distribution:

$$(750\ \text{Kg / distribution}) \times 20\% \ / \ (12\ \text{Kg / operation}) = 12.5\ \text{operations / distribution.}$$

In short, there arises no problem because the casting operations can be performed untill the subtraction counter indicates −12.5. In other words, what percentage (e.g., 80% in the present embodiment) of the total capacity of the reserving furnace is to be cast by the single distribution, is decided by considering the instant when several subtraction counters substantially- approach the value 0. At the same time, the distribution can also be manually accomplished (at o in FIG. 4) so that it may be effected before the minimum of the subtraction counters takes the value 0.

Figure 5:
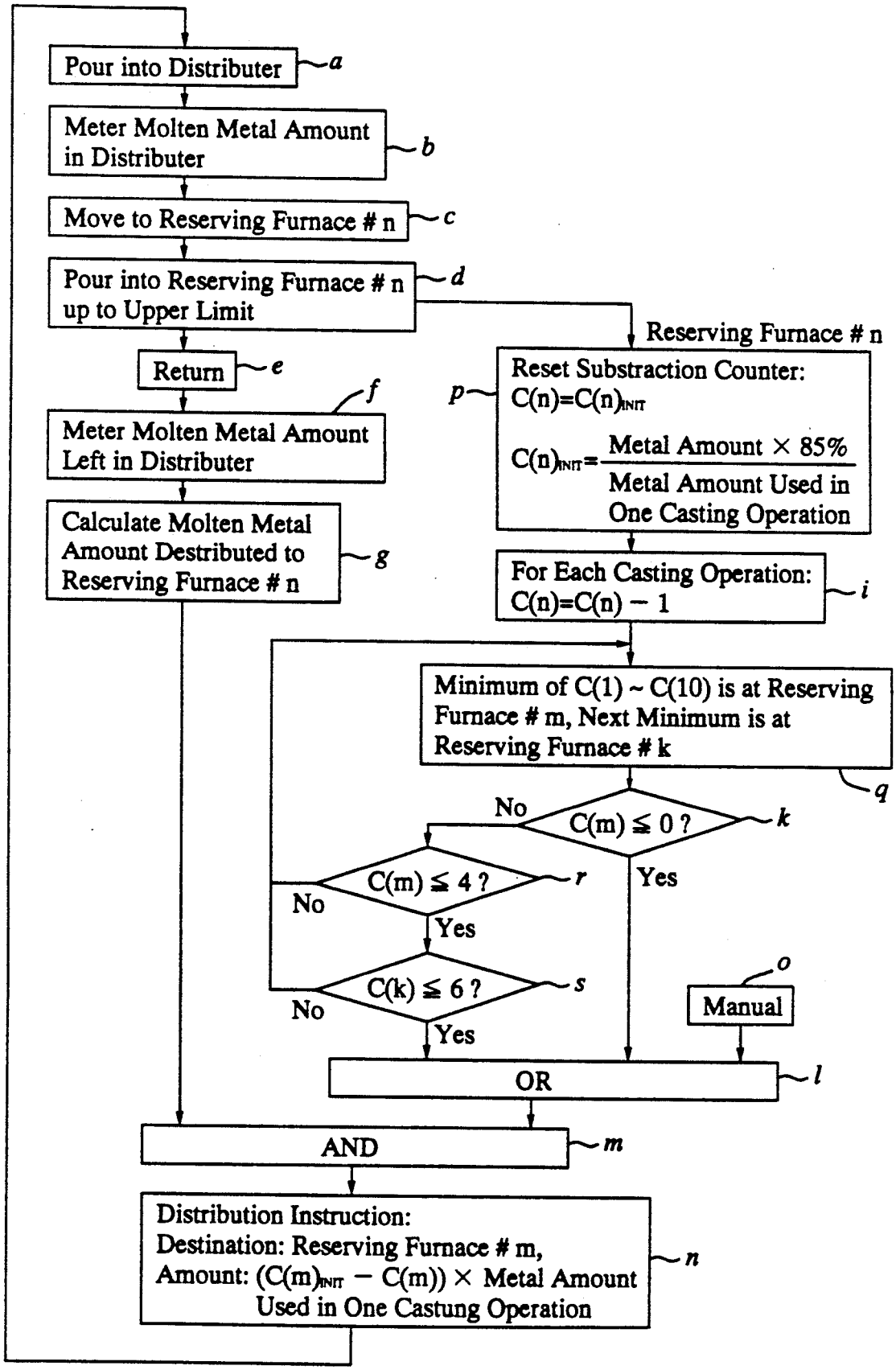
FIG. 5 is a flow chart showing control method of distributor control apparatus of another embodiment.

Since one cycle of movement of the distributor takes fifteen to twenty minutes, the time instants when the molten metal is poured to the upper limits of the individual reserving furnaces establish an interval of fifteen to twenty minutes so that it does not practically occur that the values of the many subtraction counters substantially simultaneously approach the value 0. In the embodiment thus far described, however, if the values of the subtraction counters of four casting machines should substantially simultaneously approach the value 0, the casting operation could not be accomplished by the fourth casting machine. Then, the distribution needs to be earlier started in a manual manner. Therefore, another embodiment for automatically instructing the earlier distribution will be described with reference to FIG. 5. In FIG. 5, blocks having functions identical to those of FIG. 4 are designated at the identical reference letters.

In this second embodiment, there are determined: a casting machine m which gives the minimum of the values C(n) (n=1 to 10) of the subtraction counters, i.e., the maximum in terms of the degree of approach to the preset value, of the individual casting machines; and a casting machine k which gives a value next to the minimum, i.e., the next maximum in terms of the degree of approach to the preset value (at q in FIG. 5). If the value C(m) of the subtraction counter of the m-th casting machine is 0 or less, a distribution instruction to the reserving furnace of the m-th casting machine is issued like the foregoing first embodiment (at k in FIG. 5). If the value C(m) does not reach the value 0 but is equal to or less than the first approach preset value, i.e., 4 and if the value C(k) is equal to or less than the second approach preset value, i.e., 6, then a distribution instruction to the reserving furnace of the m-th casting machine is issued (at r and s in FIG. 5).

In this second embodiment, therefore, the distribution may be started even before the value of the subtraction counter has reached the value 0. Thus, the possibility of being unable to accomplish the casting operation in any of the casting machines is reduced when the values of the subtraction counters of the plurality of casting machines substantially simultaneously approach the value 0. As a result, the percentage of what % of the total capacity of the reserving furnace is to be cast by a single distribution can be raised to 85%, for example (at p in FIG. 5). The number of opening and closing the gates of the reserving furnaces can be accordingly reduced to improve the quality of the casting articles and the casting efficiency. Incidentally, the second approach preset value, i.e., 6 is made larger than the first approach preset value, i.e., 4 in the second embodiment, but the second value may be equal to the first value, that is, the second value may be no less than the first value.

The subtraction counters are used as the basis for calculating the cast amounts in the foregoing two embodiments but can be replaced by addition counters. The reason why the subtraction counters are used is: firstly to make it easy to understand that the molten metal in the reserving furnaces is decreasing; and secondly to make it sufficient to monitor only the approach to the value 0 at all times even if the preset value such as 50 to be cast for a single distribution might be more or less different among the casing machines. Moreover, the extent of approach to the value 0 is monitored in the second embodiment in terms of the number itself of the casting operations but could be monitored in terms of the percentage of the cast amount to the preset value to be cast. This monitoring by the percentage is effective when the preset amount to be cast by the single distribution is highly different among the casting machines.

In the two embodiments each cast amount is metered from the number of casting operations at first, and then the molten metal amount left in the reserving furnace is calculated in terms of the number of possible casting operations by the metal left. In another embodiment, however, the molten metal amount left in the reserving furnace can be measured by attaching weight meter to each reserving furnace. The control method using this weight meter may be based upon the difference in weights or the weight itself measured by the meter. The former method means that the distribution will be initiated when the cast amount metered by the weight meter, i.e., difference between the present weight and the weight measured immediately after the previous pouring into the reserving furnace, reaches to the predetermined amount. The latter method means that the distribution will be initiated when the weight measured by the meter, i.e., the sum of the weight of the molten metal left and the weight of the reserving furnace, reaches to the predetermined weight. Moreover, the molten metal amount left in the reserving furnace can be measured by attaching level meter to each reserving furnace. The control method using this level meter may be based upon the difference in levels or the level itself measured by the meter. The former method means that the distribution will be initiated when the cast amount metered by the level meter, i.e., difference between the present level and the level measured immediately after the previous pouring times the internal diameter of the reserving furnace, reaches to the predetermined amount. The latter method means that the distribution will be initiated when the level measured by the meter reaches to the predetermined level.

According to the present invention, it is possible to provide an automatic molten metal distribution system which has a function to automatically decide what reserving furnace of one of the casting machines the molten metal is to be distributed to.

What is claimed is:

1. An automatic molten metal distribution system comprising:

a molten metal distributor for distributing molten metal to individual reserving furnaces of a plurality of casting machines;

cast amount metering means for metering individual cast amounts cast by said casting machines, wherein said cast amount metering means includes means for metering the individual cast amounts from counting of casting operations by the individual casting machines;

means for increasing said individual counting of the casting operations by one when gas pressure compressed in the individual reserving furnaces exceeds a pressure corresponding to a state in which the molten metal fills up cavities of the dies of the individual casting machines; and a distributor control unit comprising:

(1) means for determining the cast amount cast by each casting machine metered by said cast amount metering means, (2) means for comparing the cast amount with a preset cast amount based on an output of the comparing means, the preset cast amount being the same or different among the plurality of casting machines, and (3) means for controlling said distributor to distribute molten metal to the reserving furnaces of said casting machines as the respective preset cast amount are reached.

2. An automatic molten metal distribution system comprising:

a molten metal distributor for distributing molten metal to individual reserving furnaces of a plurality of casting machines;

cast amount metering means for metering individual cast amounts cast by said casting machines; and a distributor control unit comprising (1) means for determining the cast amount cast by each casting machine metered by said cast amount metering means, (2) means for comparing the cast amount with a preset cast amount based on an output of the comparing means, the preset cast amount being the same or different among the plurality of casting machines, (3) means for calculating individual extent of approach of said individual cast amounts to said individual preset cast amounts to determine the maximum and next maximum in said extent of approach, and (4) means for controlling said distributor to distribute molten metal to the reserving furnace of the casting machine having said maximum when said maximum reaches a first preset approach value and said next maximum reaches a second preset approach value less close than said first preset approach value.

3. An automatic molten metal distribution system according to claim 2, wherein said cast amount metering means includes means for metering the individual cast amounts from counting of casting operations by the individual casting machines.

4. An automatic molten metal distribution system according to claim 3, further comprising means for increasing said individual counting of the casting operations by one when gas pressure compressed in the individual reserving furnaces exceeds a pressure corresponding to a state in which the molten metal fills up cavities of the dies of the individual casting machines.

5. An automatic molten metal distribution system according to claim 2, wherein said cast amount metering means includes means for metering the individual cast amounts from individual weight of the molten metal in the reserving furnaces of the casting machines.

6. An automatic molten metal distribution system according to claim 2, wherein said cast amount metering means includes means for metering the individual cast amounts from individual height of the molten metal in the reserving furnaces of the casting machines.

7. A method for automatically distributing molten metal from a distributor to individual reserving furnaces of a plurality of casting machines, comprising the steps of:

metering the individual cast amount cast by said casting machines, wherein the metering step comprises metering the individual cast amounts from counting of casting operations by the individual casting machines, and said individual counting of the casting operations is increased by one when gas pressure compressed in the individual reserving furnaces exceeds a pressure corresponding to a state in which the molten metal fills up cavities of the dies of the individual casting machines;

comparing the cast amount with a preset cast amount, the preset cast amount being the same or different among the plurality of casting machines; and distributing molten metal to the reserving furnaces of said casting machines as the respective cast amounts are reached.

8. A method for automatically distributing molten metal from a distributor to individual reserving furnaces of a plurality of casting machines, comprising sets of:

metering the individual cast amounts cast by said casting machines;

comparing the cast amount with a preset cast amount, the preset cast amount being the same or different among the plurality of casting machines;

calculating individual extent of approach of the individual cast amounts to the individual preset cast amounts to determine the maximum and next maximum in the extent of approach; and distributing molten metal to the reserving furnace of the casting machine having said maximum when said maximum reaches a first preset approach value and said next maximum reaches a second preset approach value less close than said first preset approach value.

9. The method of claim 8, wherein the metering step comprises metering the individual cast amounts from counting of casting operations by the individual casting machines.

10. The method claim 9, wherein said individual counting of the casting operations is increased by one when gas pressure compressed in the individual reserving furnaces exceeds a pressure corresponding to a state in which the molten metal fills up cavities of the dies of the individual casting machines.

11. The method of claim 8, wherein the metering step comprises metering the individual cast amounts from individual weight of the molten metal in the reserving furnaces of the casting machines.

12. The method of claim 8, wherein the metering step comprises metering the individual cast amounts from individual height of the molten metal in the reserving furnaces of the casting machines.

* * * * *